US006931816B2

(12) United States Patent
Roth

(10) Patent No.: US 6,931,816 B2
(45) Date of Patent: Aug. 23, 2005

(54) PACKAGING MECHANISM AND METHOD OF USE

(75) Inventor: J. Edward Roth, Lansdale, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/602,873

(22) Filed: Jun. 25, 2003

(65) Prior Publication Data

US 2004/0261367 A1 Dec. 30, 2004

(51) Int. Cl.[7] ..... B65B 49/00
(52) U.S. Cl. ..... 53/228; 53/203; 53/218
(58) Field of Search ..... 53/461, 463, 464, 53/466, 465, 206, 209, 210, 218, 228, 510, 512, 288

(56) References Cited

U.S. PATENT DOCUMENTS

| | | | | |
|---|---|---|---|---|
| 3,000,151 A | | 9/1961 | Winkler et al. | |
| 3,848,014 A | * | 11/1974 | Uchiyama et al. | 585/487 |
| 3,948,387 A | * | 4/1976 | Haertle | 53/463 |
| 3,973,372 A | | 8/1976 | Omori | |
| 4,617,784 A | | 10/1986 | Golicz et al. | |
| 4,676,051 A | | 6/1987 | Hoskinson et al. | |
| 4,903,459 A | * | 2/1990 | Okinaka | 53/512 |
| 4,991,376 A | * | 2/1991 | Backman | 53/463 |
| 4,999,977 A | | 3/1991 | Briscoe et al. | |
| 5,027,578 A | * | 7/1991 | Natterer et al. | 53/512 |
| 5,135,352 A | | 8/1992 | Scata et al. | |
| 5,209,043 A | * | 5/1993 | Kupcikevicius | 53/512 |
| 5,386,678 A | * | 2/1995 | Kujubu | 53/512 |
| 5,588,285 A | | 12/1996 | Odenthal | |
| 5,615,537 A | * | 4/1997 | Vollenweider | 53/466 |
| 5,718,098 A | | 2/1998 | Grosskopf et al. | |
| 5,822,956 A | * | 10/1998 | Liechti et al. | 53/510 |
| 5,934,048 A | * | 8/1999 | Bouressa | 53/552 |
| 6,241,099 B1 | | 6/2001 | Hendrickson et al. | |
| 6,308,493 B1 | | 10/2001 | Mack et al. | |
| 6,415,582 B2 | | 7/2002 | Graushar et al. | |
| 6,443,311 B2 | | 9/2002 | Hendrickson et al. | |
| 6,539,689 B1 | * | 4/2003 | Yoshimoto | 53/512 |
| 2001/0009234 A1 | | 7/2001 | Hendrickson et al. | |
| 2001/0011796 A1 | | 8/2001 | Hendrickson et al. | |
| 2001/0014270 A1 | | 8/2001 | Hendrickson et al. | |
| 2002/0023861 A1 | | 2/2002 | Mileaf et al. | |
| 2002/0074268 A1 | | 6/2002 | Hendrickson et al. | |

FOREIGN PATENT DOCUMENTS

| | | |
|---|---|---|
| WO | 02/058855 | 8/2002 |

* cited by examiner

*Primary Examiner*—Louis Huynh
(74) *Attorney, Agent, or Firm*—Greenblum & Bernstein, P.L.C.

(57) ABSTRACT

A packaging mechanism has a loading bed moveable between a loading position and a second position. A plate-like member is moveable with respect to the loading bed between a retracted position for loading and a second position for package sealing. The plate-like member has a hinged portion. A sealing member is positioned at an end of the hinged portion. The sealing member seals a wrap about a sequenced group of product to form a package when the plate-like member is positioned over the loading bed. A clamping, cutting and serrate mechanism is positioned proximate to the loading bed when the loading bed is in the first position. The clamping, cutting and serrate mechanism clamps, cuts and serrates the wrap. A method of packaging is also provided.

20 Claims, 14 Drawing Sheets

PACKAGING MECHANISM AND METHOD OF USE

BACKGROUND OF THE INVENTION

1. Field of the Invention

The present invention generally relates to a packaging mechanism and method of use and, more particularly, to a packaging mechanism for packaging mail objects such as letters, packages and flats for each delivery point as well as other types of objects or product and a method of use.

2. Background Description

The sorting of mail and other types of objects or products is a very complex, time consuming task. In general, the sorting of mail objects such as letters and flats are processed though many stages, including back end processes. In the back end processes, the mail objects are sorted and then sequenced into a delivery point sequence for future delivery to specific delivery point addresses. The sorting and sequencing processes can either be manual or automated, depending on the mail sorting facility, the type of mail object be sorted such as packages, flats, letters and the like. A host of other factors may also contribute to the automation of mail sorting and sequencing, from budgetary concerns to modernization initiatives to access to appropriate technologies to a host of other factors.

In general, most modern postal and other type of mail handling facilities have taken major steps toward automation by the implementation of a number of technologies. These technologies include, amongst others, letter sorters, parcel sorters, advanced tray conveyors, flat sorters and the like. As a result of these developments, postal facilities and other handling facilities have become quite automated over the years, considerably reducing overhead costs.

But, the largest individual cost of the mail handling system, i.e., processing, transportation and delivery, is the delivery portion of the process. This is the process of preparing the mail objects such as letters and flats into a delivery point sequence and then performing the actual delivery to each delivery address. The automation of sequencing mail objects is known in many forms. By way of example, it is known to sequence letters using a mail sorter based on, for example, a two pass sorting scheme. Of course, other known systems can equally be used to sort and sequence mail objects, a host of them readily available and known to those of ordinary skill in the art.

Now, at the end of the sequencing process, the letters or other objects are merged and placed into a tub or container in the sequence of delivery. But, the letters and other objects are merely placed in a tub or container in sequence without any physical constraints between each of the delivery point addresses. Thus, at the time of delivery the postal carrier must physically separate the mail objects from one delivery point address to the next delivery point address. This includes reading and, in instances, correlating different mail pieces for the same delivery point address. Such a task is very time consuming, and is a task prone to errors potentially resulting in the incorrect delivery of mail.

It is also known that in mixed mail scenarios, i.e., flats, letters, married mail, etc., each different type of object may be placed in a separate tub or container. In this case, the postal carrier must "sift" through each of the tubs or containers for each delivery point address. Although, each of the different types of mail pieces are in a delivery point sequence, there still remains no physical constraint between each of the delivery point addresses. Thus, the carrier must still filter through each of the tubs or containers for each address to ensure that the mail objects are being properly delivered. This, of course, is a very time consuming and error prone, too.

The present invention is directed to overcoming one or more of the problems as set forth above.

SUMMARY OF THE INVENTION

In a first aspect of the invention, the packaging mechanism has a loading bed moveable between a loading position and a second position. A plate-like member is moveable with respect to the loading bed between a loading position and a second position. The plate-like member has a hinged portion. A sealing member is positioned at an end of the hinged portion. The sealing member seals a wrap about a sequenced group of product to form a package when the plate-like member is positioned over the loading bed.

In an embodiment, the loading position of the loading bed is a raised position descending to a lowered position as product is placed on the loading bed. The lowered position of the loading bed may be a height which allows the plate-like member to laterally move over the product when the product is placed on the loading bed. The loading position of the loading bed may also be a position aligned with a drop-off point of the product and the second position of the loading bed may be a remote position for dropping the package therefrom. The positions of the plate-like structure may be a lowered or raised position, as well as a sorting position and a wrapping position.

In another aspect of the invention, a packaging mechanism includes a loading bed moveable between a first position and a second position and a bag former mechanism moveable with respect to the loading bed between a first position and a second position. A hinged portion is positioned at an end of the bag former mechanism. A sealing member is positioned at an end of the hinged portion, where the sealing member seals a wrap about a group of product to form a package when the hinged bag former mechanism is positioned over the loading bed. A clamping, cutting and serrate mechanism is positioned proximate to the loading bed when the loading bed is in the first position. The clamping, cutting and serrate mechanism clamps the wrap during the movement of the bag former mechanism to the second position and cuts and serrates the wrap after the sealing member seals the wrap to form the package.

In another aspect of the invention, a method of packaging a sequenced group of product for a delivery point is provided. In this aspect, the steps include:

1. stacking product on a first platform in a sequenced arrangement;
2. moving wrap over the stacked product by moving a plate-like structure over the stacked product;
3. holding a portion of the wrap during the moving stage;
4. lowering a hinged portion to rest on the first platform; and
5. sealing the wrap about the stacked product.

In further embodiments, the method includes lowering the first platform during or after the stacking step and serrating the wrap after the sealing of the wrap. Further movements of the first platform and the plate-like structure are also contemplated by the method of the present invention.

In yet still another aspect of the invention, an apparatus is provided including a sequencing device that sequences mail objects and a packaging mechanism which packages sequenced mail objects for delivery routes provided by the sequencing device. The packaging mechanism includes a loading bed and bag former mechanism each moveable between two positions. A hinged portion is positioned at an end of the bag former mechanism and a member is provided to seal a wrap about a group of sequenced mail objects to form a package.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF EMBODIMENTS OF THE INVENTION

The present invention is directed to a packaging mechanism and more particular to a mechanism capable of packaging sequenced products such as, for example, flats and other mail items (i.e., letters), into a merged, sequenced package for future delivery or warehousing or the like. In aspects of the present invention, the products may be packaged into separate deliverable packages at a downstream point, after the sequencing of such products. The apparatus and method of the present invention significantly reduces processing times for delivering products such as flats and mail pieces or other disparate products in delivery point sequence. Other applications such as warehousing and storage applications are also contemplated for use with the present invention.

Packaging Mechanism of the Invention

Figure 1:
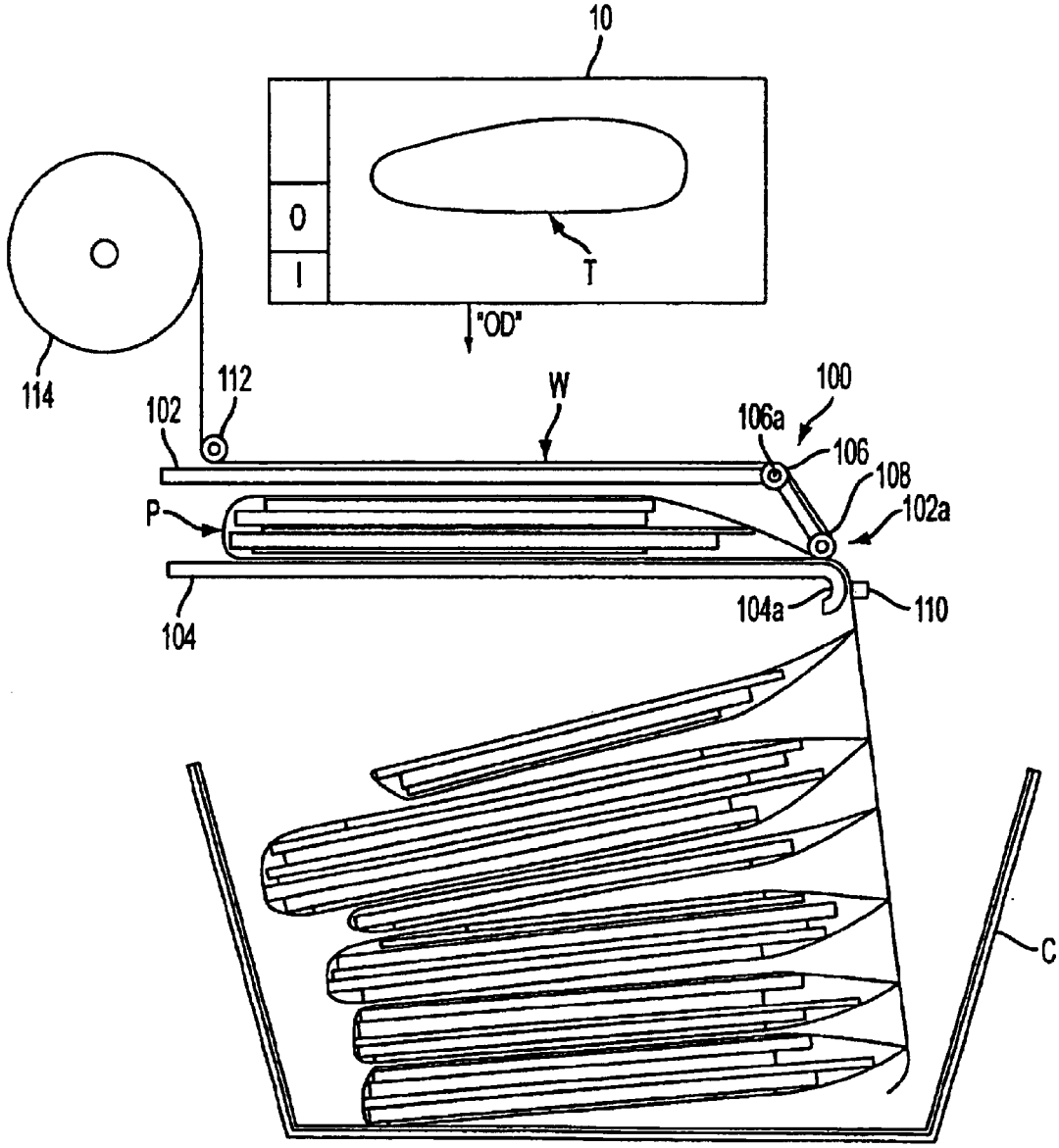
FIG. 1 shows a general schematic diagram of the packaging mechanism of the present invention.

Referring now to FIG. 1, a general schematic diagram of the packaging mechanism of the present invention is shown. In the embodiment of FIG. 1, the packaging mechanism is generally depicted as reference numeral 100 and is downstream from a sequencing device generally depicted as reference numeral 10. The sequencing device includes an optical system "0" for reading mail objects and other types of products, as well as an input mechanism "I", transporting mechanism "T" and an output device "OD" feeding the product to the packaging mechanism 100. The sequencing device is capable of sequencing product in a delivery point sequence as is well understood in the art, and may be any sequencing device, for example, manufactured by Lockheed Martin Federal Systems.

The packaging mechanism 100 includes a bag forming mechanism 102 (e.g., a plate-like member) and a bag bed plate or loading plate 104. The bag bed plate 104 is, in an embodiment, positioned below the bag forming mechanism 102. In an embodiment, the bag forming mechanism 102 includes a hinged portion 106 and a sealing mechanism 108 at a distal end 102*a* thereof. The sealing mechanism 108 may be a roller or other sliding mechanism capable of sealing a bag about a package of sequenced products "P". This may include a heating device, or other sealing mechanism. The hinged portion 106 tilts between a downwardly angled position and 180°, and may be controlled by an actuator, hydraulic system or other known driving device 106*a*. Of course, other angles are also contemplated by the present invention.

The bag forming mechanism 102 and the bag bed plate 104 are slidable between a first position and a second position (see FIGS. 2–12) by using any conventional moving mechanism such as a chain drive, direct drive, linear motor, hydraulic system or the like. The first position of the bag bed plate 104 and the first (i.e., retracted or sort) position of the bag former mechanism 102 may be a loading position. The bag bed plate 104 is also capable of being raised and lowered during the packaging stage, either of which may also be a loading position. In an alternative embodiment, the bag former mechanism 102 may be lowered or raised instead of the bag bed plate 104. In either embodiment, the raising and lowering movement may be performed by any conventional mechanism, including by way of example a hydraulic system or a spring loaded mechanism.

Still referring to FIG. 1, the bag bed plate 104 includes, in one embodiment, a curved end 104*a*. In another embodiment, the end 104*a* may simply be straight or other configuration, none of which are limiting features of the invention, The curved end 104*a,* though, may facilitate the packaging and drop off of the formed package, itself. A clamping, cutting and serrate mechanism 110 is also provided. Additionally, a roller or bar-type structure 112 is positioned near a top surface of the bag forming mechanism 102 at a state of operation. The structure 112 directs wrapping "W" from a wrapping supply roll 114 to the packaging mechanism 100. A tub or container "C" is used to hold the sequenced product "P". The container "C" makes no part of the present invention, and is shown for illustrative purposes.

Method of Packaging Product Using the Packaging Mechanism of the Invention

FIGS. 2–13 show several stages of packaging objects using the packaging mechanism 100 of the present invention. The packaging mechanism 100 may be positioned on a mail or product sequencing machine at a point where the mail object is normally output in a delivery point sequence into a container for transport to a delivery unit. The packaging mechanism 100 of the present invention receives the mail objects or other types of product such as a package, flat, letter and the like (generally referred to hereinafter as "product") for each delivery point, forms a package or bag about the product and then loads the packaged sequenced product into the container. The wrap "W" may be serrated at a stage of operation so that the bag for each delivery point may be separated at each delivery point by the carrier or at a storage facility.

Figure 2:
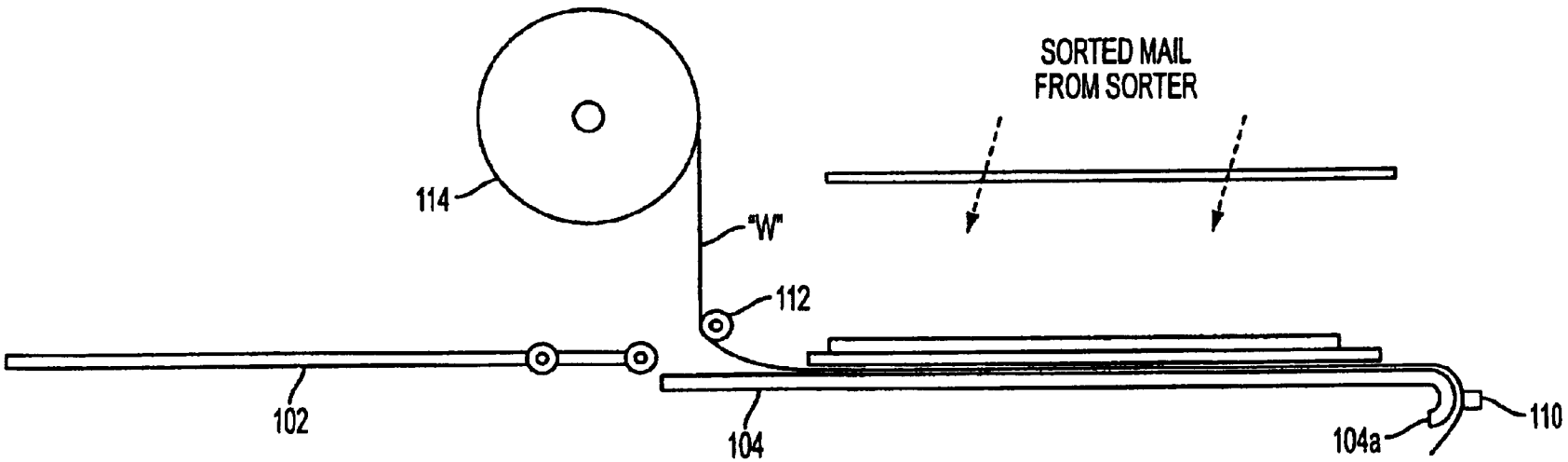
FIGS. 2–13 show several stages for packaging objects using the packaging mechanism of the present invention.

In FIG. 2, the bag forming mechanism 102 is in a retracted position and the bag plate 104 is in a first or loading position. The wrap "W" is provided about the roller or bar-type structure 112 and is positioned on a top surface of the bag bed plate 104. The sequenced product are placed over the wrap "W" on the top surface of the bag bed plate 104 in a sequenced order. In the stage of operation of FIG. 2, the hinged portion 106 is in a same plane as the remaining portions of the bag forming mechanism 102 (i.e., 180°).

Figure 3:
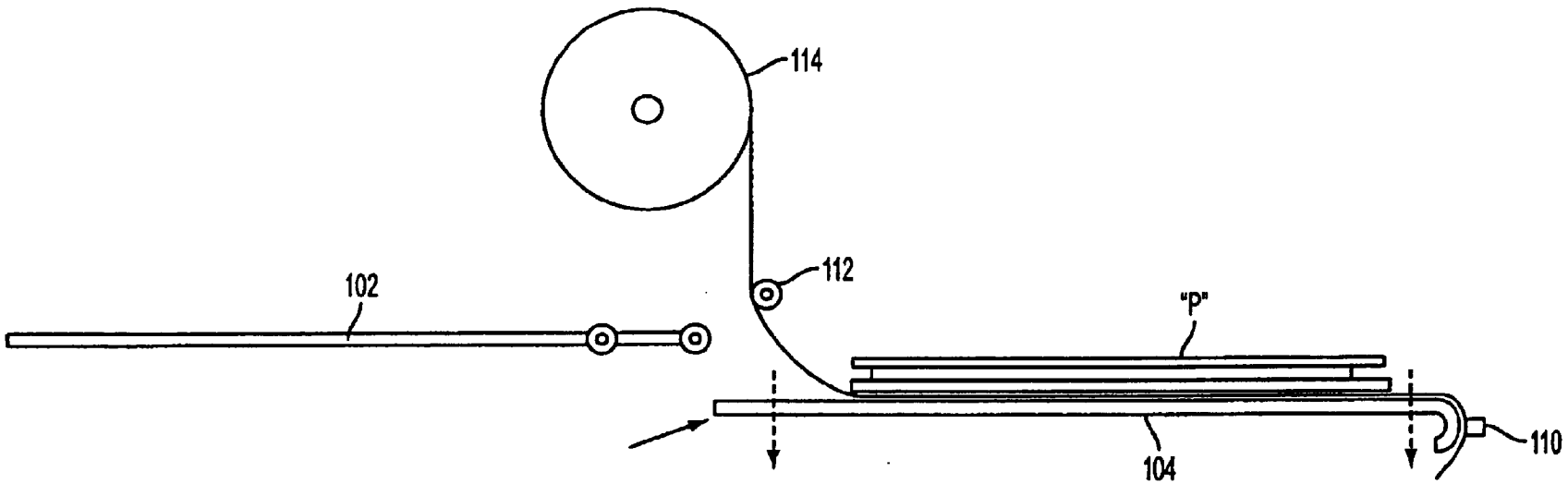

In FIG. 3, as the sequenced product for a single delivery point is provided on the bag bed plate 104, the bag bed plate 104 begins to descend or lower a predetermined distance. In one embodiment, the bag bed plate 104 and any product thereon is lowered to below a bottom surface of the bag former mechanism 102. At this stage of operation, the wrap "W" will begin to unroll from the supply roll 114. The bag former mechanism 102 may, alternatively, be raised at this stage and then lowered at another operational stage. The clamping mechanism 110 may be used to hold the wrap "W" during the descent of the bag bed plate 104.

Figure 4:
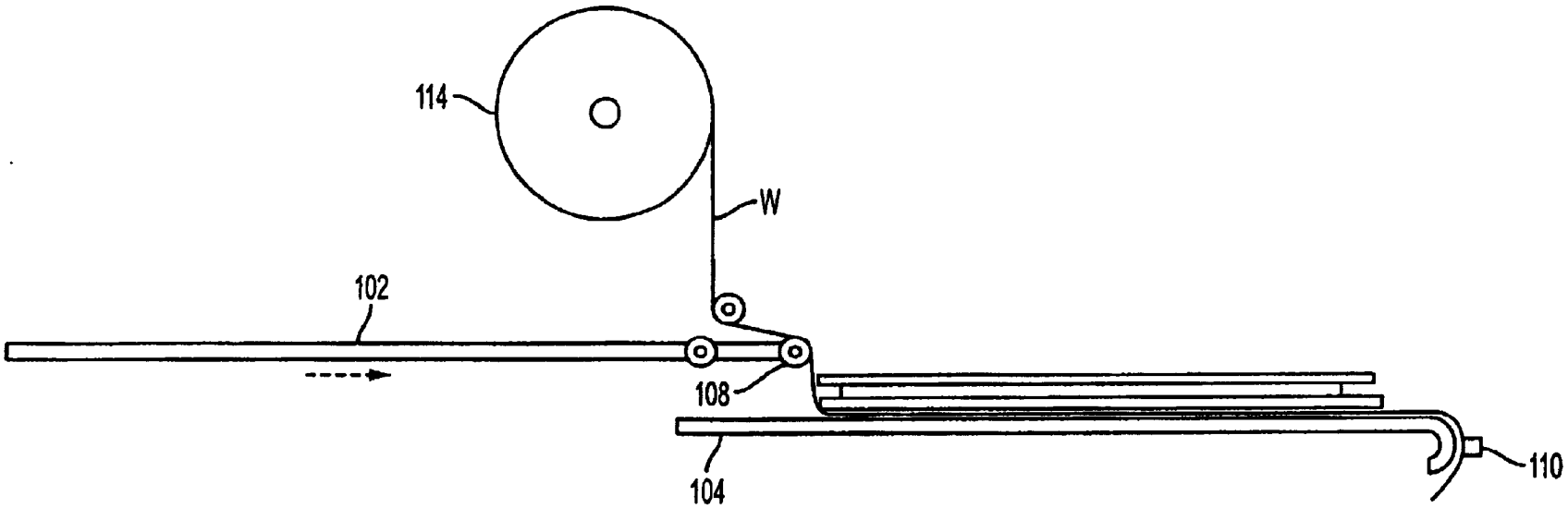

After all of the product for a delivery point is placed on the bag bed plate 104 and it is appropriately lowered, the bag former mechanism 102 begins to move toward the bag bed plate 104 as shown in FIG. 4. During this movement, the sealing mechanism 108 contacts the wrap "W" along the sides and below the structure 112 and begins to move the wrap "W" over the product. The clamping, cutting and serrate mechanism 110 will hold the wrap "W" against the end 104*a*, at this stage, to ensure that the wrap "W" will properly disengage or roll from the supply roll 114 over the top of the product. The clamp may also be a self contained mechanism which does not require an end 104*a* of the bag bed plate 104.

Figure 5:
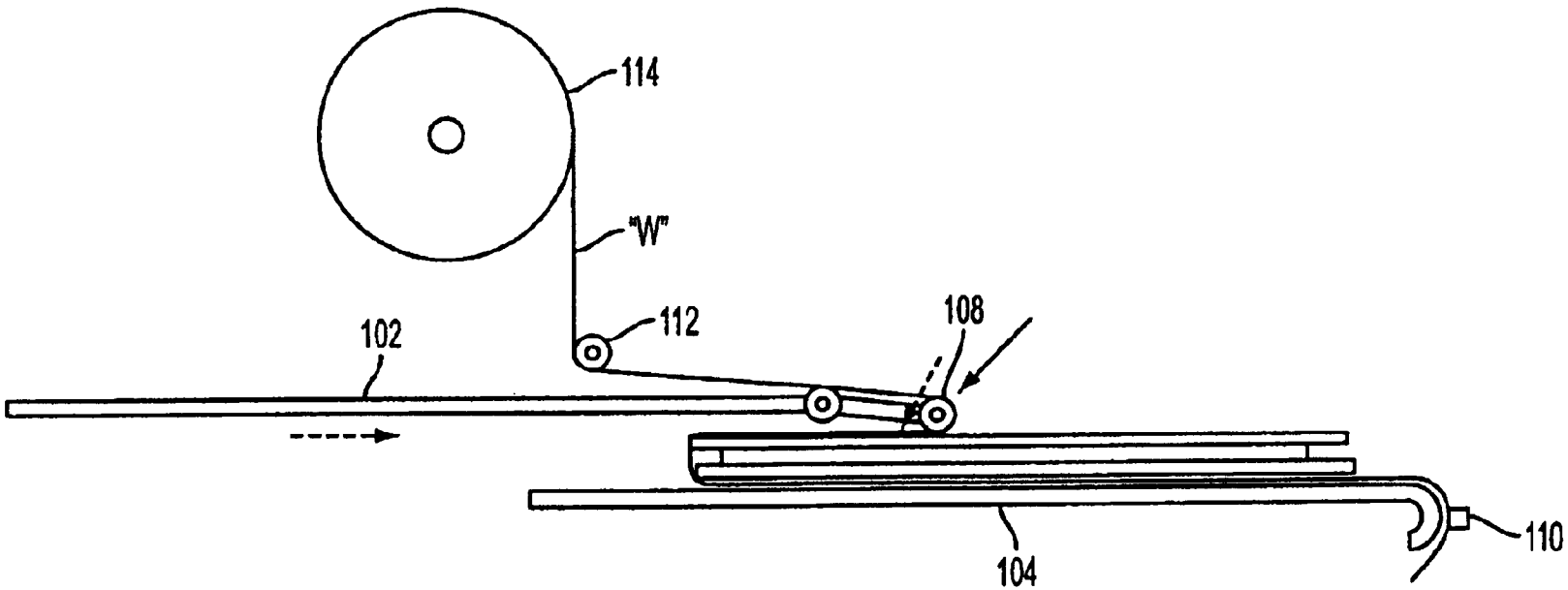
Figure 6:
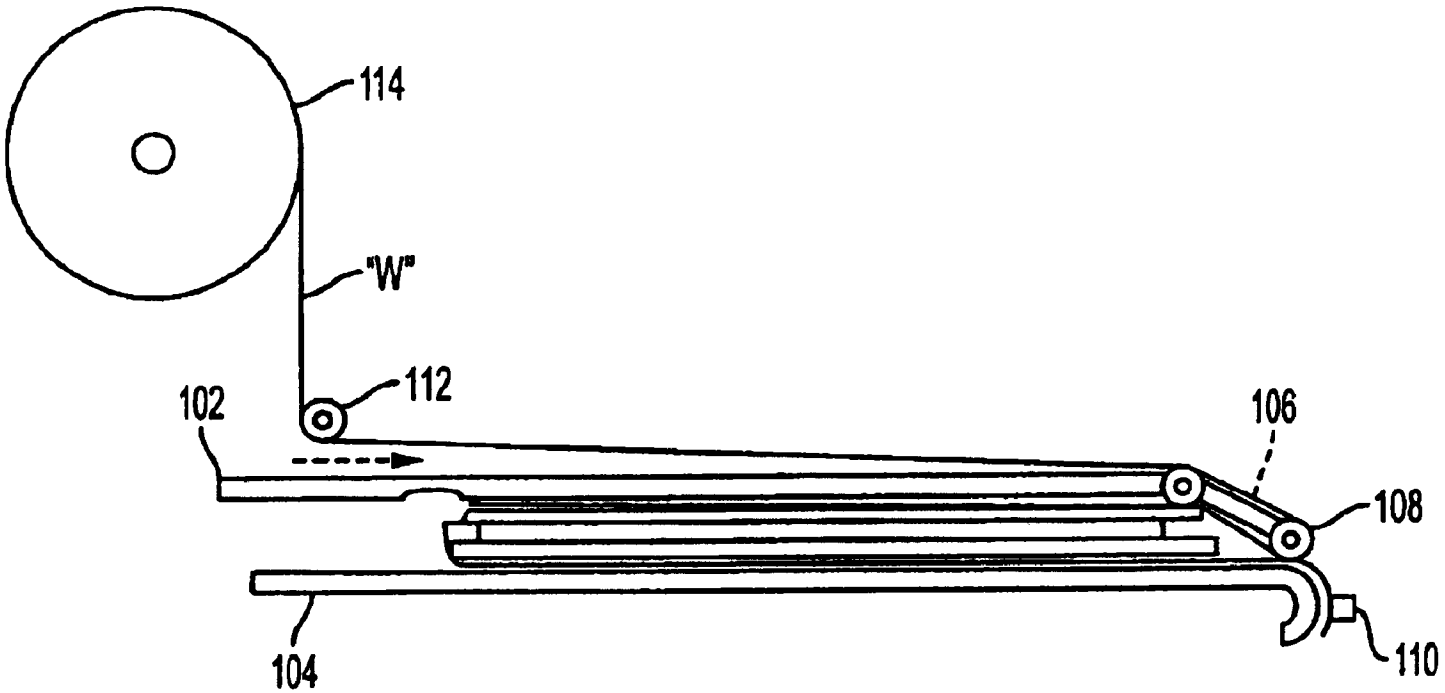

The bag former mechanism 102 moves completely over the product to the second position (FIGS. 5 and 6). During the stages shown in FIGS. 5 and 6, the wrap "W" is moved or pushed completely over the product while the sealer 108 (roller or end) follows over the top and, in embodiments, the sides, of the product. At the end of this operational stage, the sealer 108 at the end of the hinged portion 106 of the bag former mechanism 102 will rest on the top surface of the bag bed plate 104 and close or seal the bag (i.e., seal an upper layer of the wrap to a lower layer of the wrap) at an end thereof.

Still referring to FIG. 6, the hinged portion 106 will now be at an angled position due, basically, to the height of the stacked product on the bag bed late 104. The bag former mechanism 102 seals the sides and top of the packaged product through the use of the sealer 108, using heat or other known sealing techniques. Also, during this operational stage, the wrap "W" is positioned over and underneath the surfaces of the bag former mechanism 102. The clamping, cutting, serrate mechanism 110 will serrate the top of the bag for future tear off.

Figure 7:
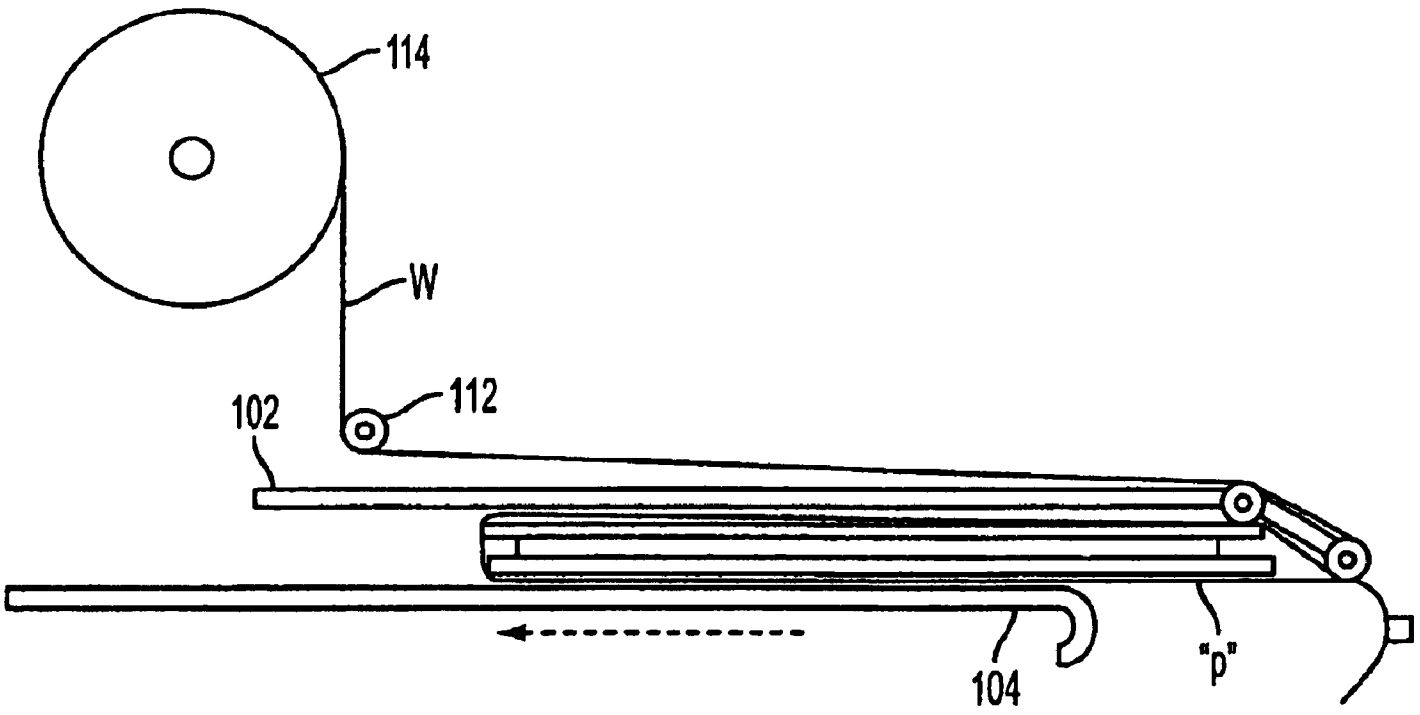
Figure 8:
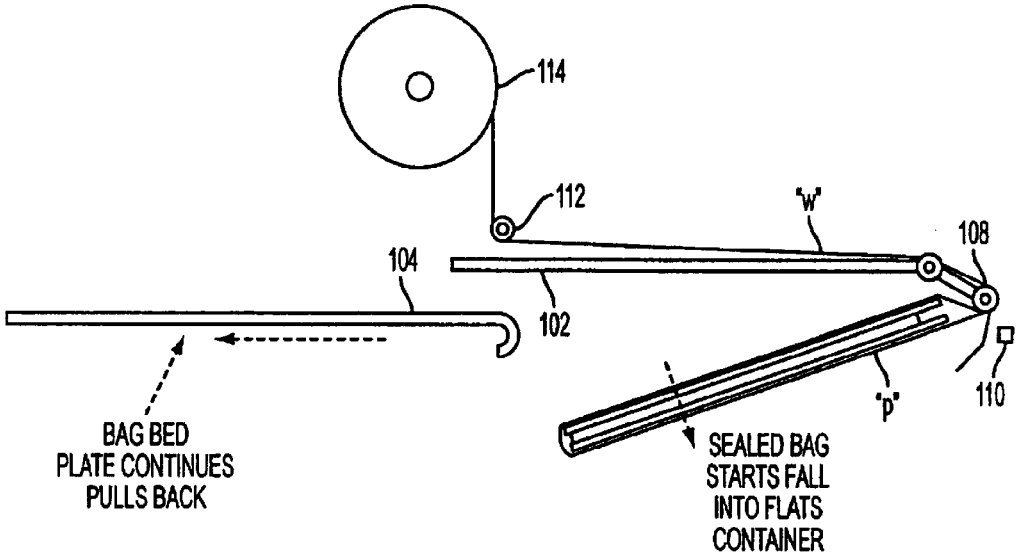
Figure 9:
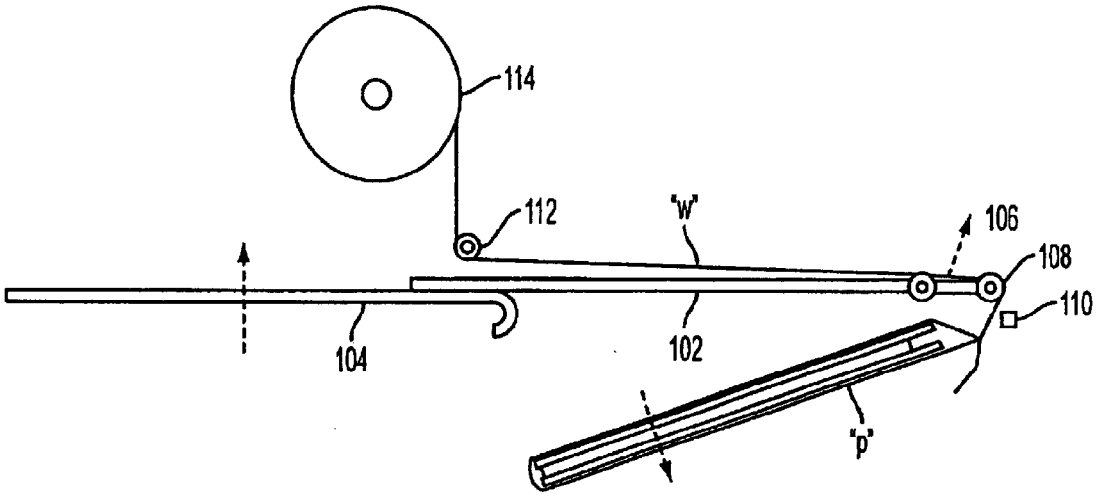

In FIG. 7, the bag bed plate 104 begins to retract, while the packaged sequenced product "P" remains substantially stationary. In FIG. 8, the bag bed plate 104 is fully retracted. During these operational stages, the packaged sequenced product "P" for the delivery point begins to fall into the container. After the retraction, the bag bed plate 102 rises to a load level and the hinged portion 106 of the bag former mechanism 102 is raised, as shown in FIGS. 8 and 9. It should be understood by those of ordinary skill in the art that the present invention is not limited to only this sequence of events; that is, the hinged portion 106 of the bag former mechanism 102 as well as the bag bed plate 102 may rise simultaneously or in any desired order.

Figure 10:
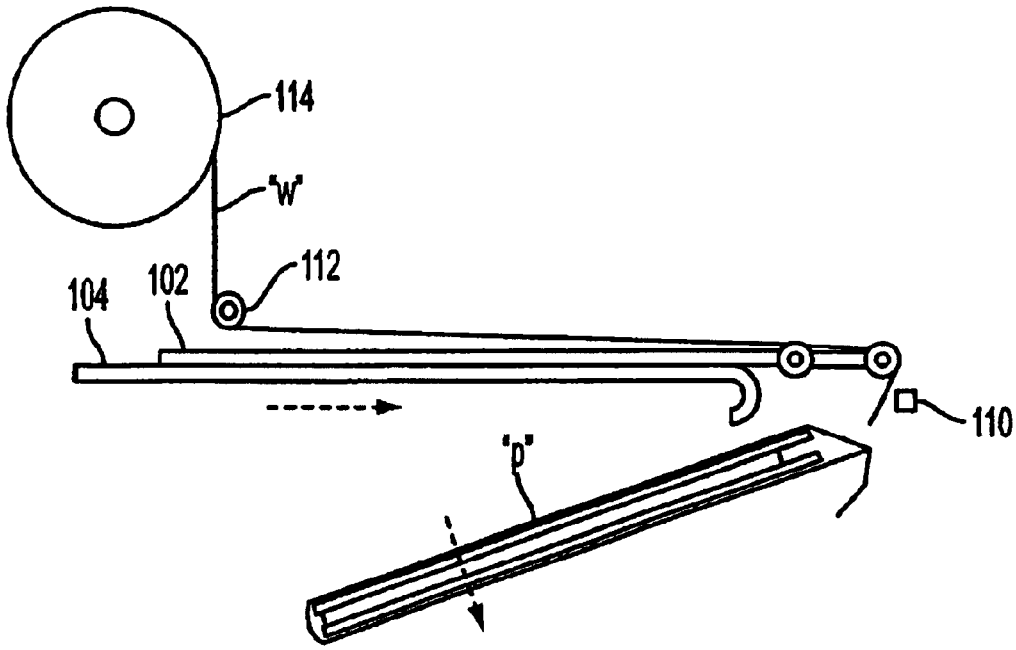
Figure 11:
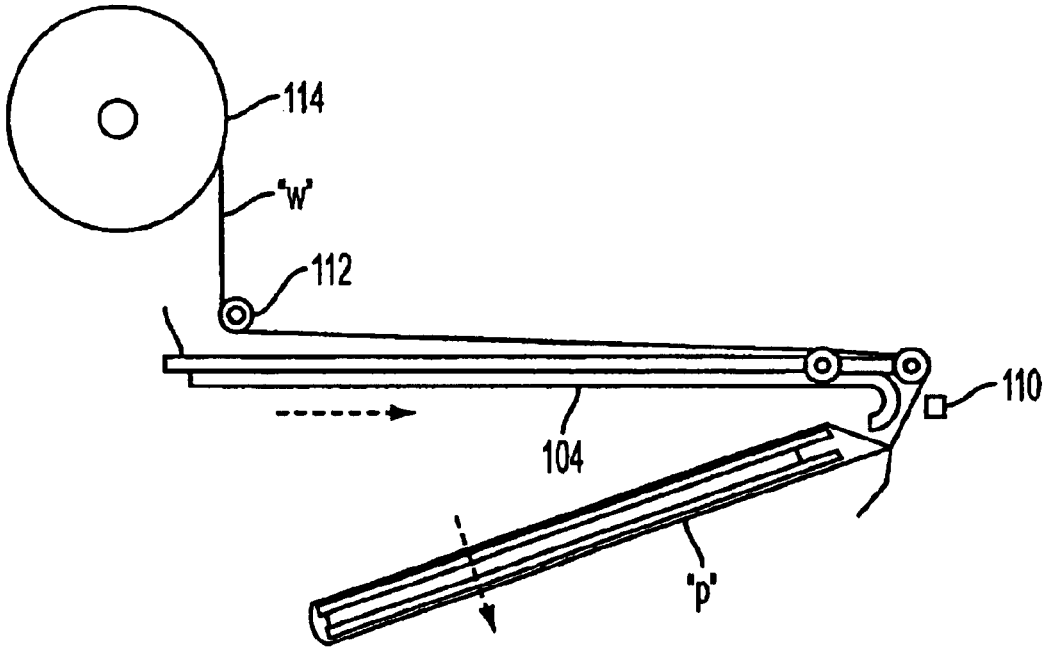
Figure 12:
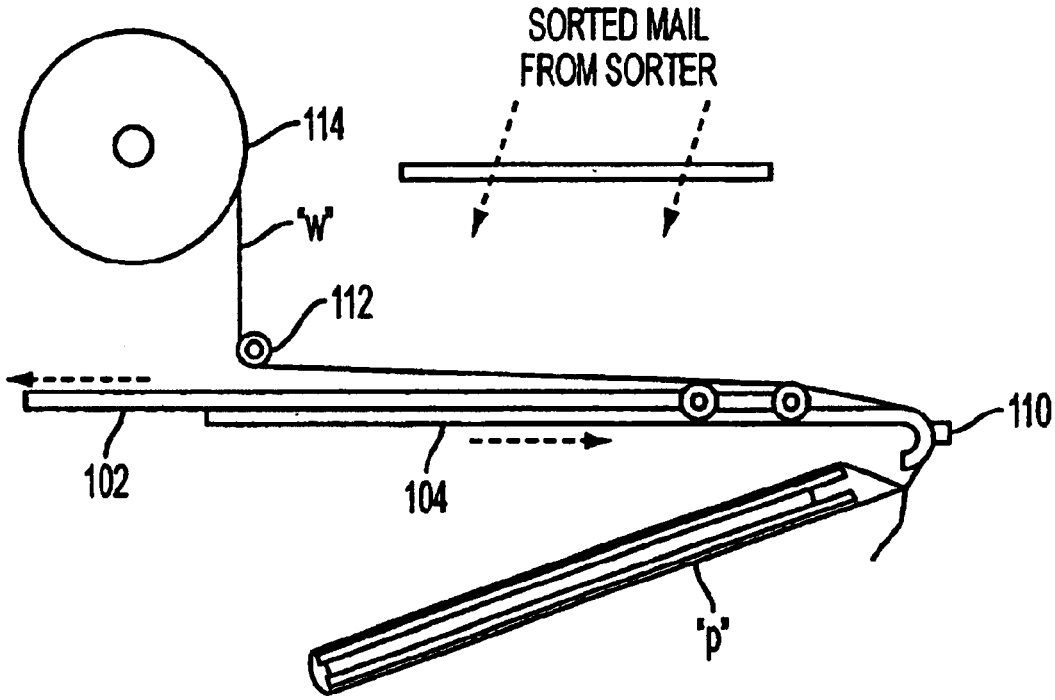
Figure 13:
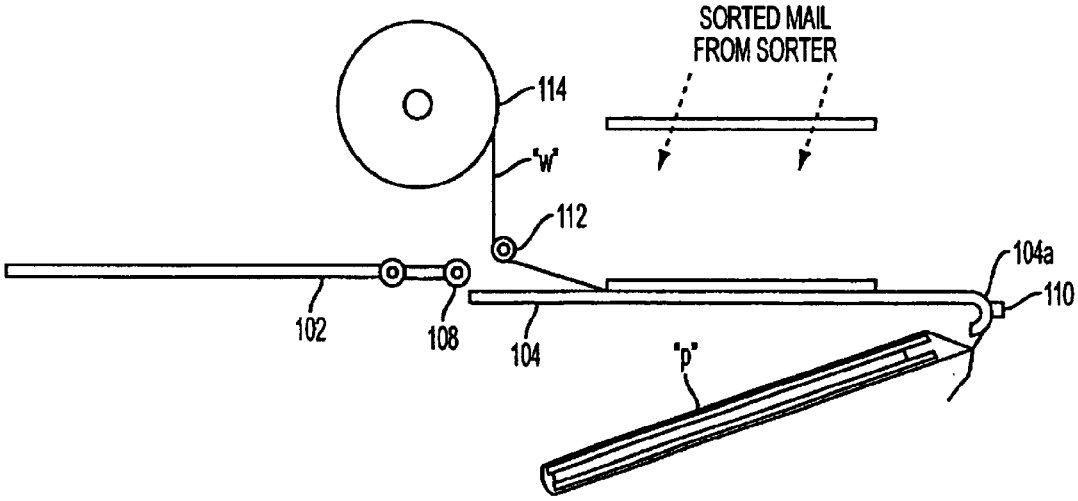

FIGS. 10 and 11 show the bag bed plate 104 moving forward towards the first or loading position. FIGS. 12 and 13 show the bag former mechanism 102 pulling back to the retracted or sort position. During this movement, in one embodiment, the clamping, cutting and serrate mechanism 110 clamps the wrap against the end 104*a* of the bag bed plate 104, while the package "P" continues to fall towards the container. The clamping may be performed in a self contained unit, as well. FIG. 13 also shows the process starting again, similar to that of FIG. 2. The operational stages of FIGS. 10–13 may be interchangeable. (FIG. 1 shows stacks of packaged product in the container.)

Figure 14:
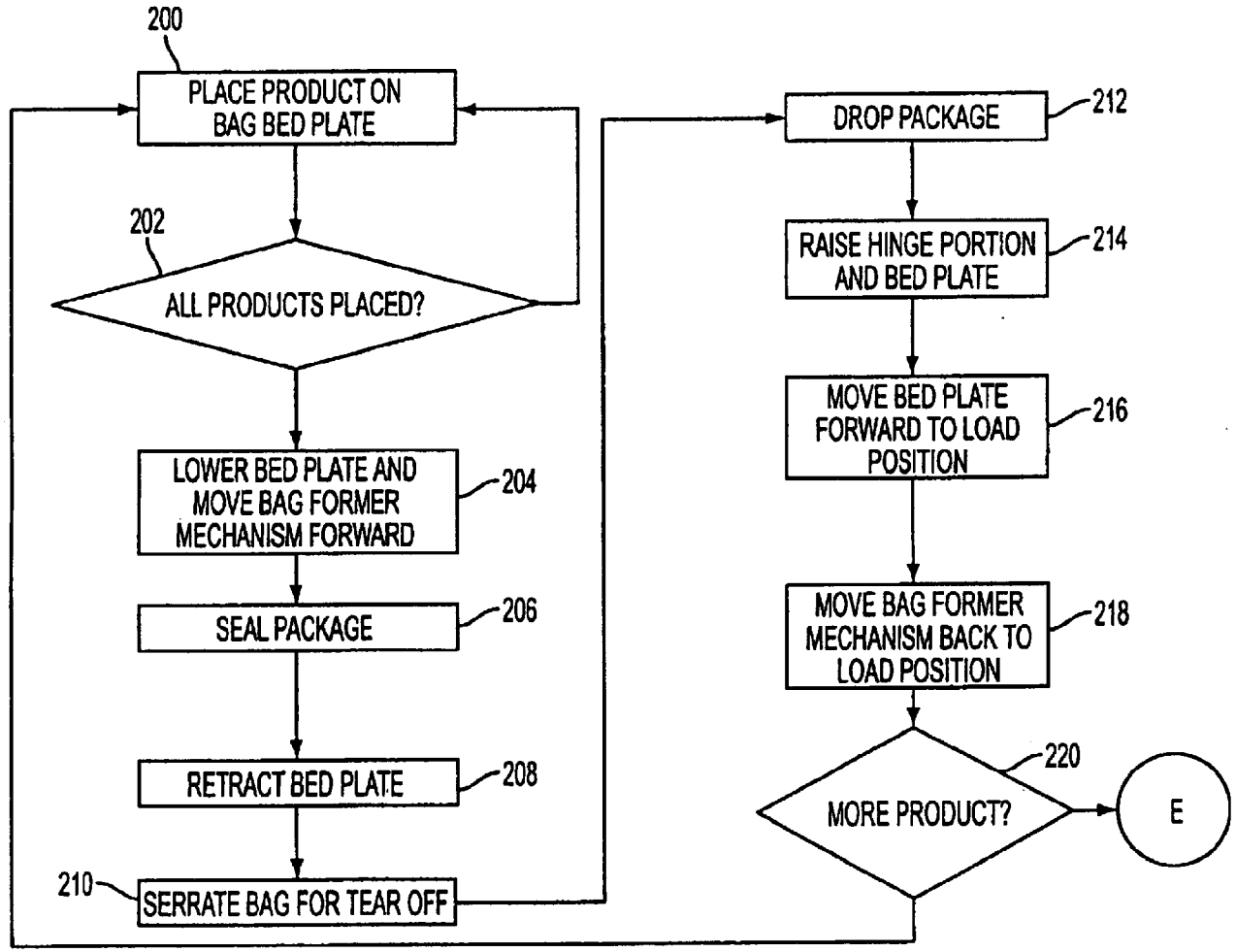
FIG. 14 is a flow diagram showing the steps of implementing the method of the present invention.

FIG. 14 is a flow chart showing the steps implementing the present invention. In step 200, the product is placed on the bed plate 104 from, in an embodiment, a sequencing device. In step 202, a determination is made as to whether all of the product is placed on the bed plate 104 for a specific delivery point. If not, the method returns to step 200. If all the product is placed on the bed plate 104 for a specific delivery point, at step 204, the bed plate 104 is lowered and the bag former mechanism 102 is moved forward. The bed bag plate 104 may descend or lower during the stacking of the product. Alternatively, the bag former mechanism may be lifted above the stacked product.

The package of product is then sealed at step 206, and the bed plate 104 begins to retract at step 208. At step 210, the system will serrate the bag and the package will drop into the container at step 212. The hinged portion 106 of the bag former mechanism 102 and the bed plate 104 are raised. It should be understood that steps 210–214 may be performed in order, simultaneously or in other logical order, depending on the desires of the developer. At step 216, the bed plate 104 is moved to the loading position. At step 218, the bag former mechanism 102 is moved to the loading (retracted) position. Steps 216 and 218 may be performed simultaneously or in reverse order. A determination is then made at step 220 to determine whether more product will be packaged from the sorter. If so, the method returns to step 200. If not, the method ends at "E".

While the invention has been described in terms of embodiments, those skilled in the art will recognize that the invention can be practiced with modification within the spirit and scope of the appended claims.

I claim:

1. An apparatus, comprising:

a loading bed moveable between a loading position and a second position;

a plate-like member moveable with respect to the loading bed between a plate-like member loading position and a second plate-like member position, the plate-like member having a hinged portion; and a sealing member positioned at an end of the hinged portion, the sealing member cooperating with the loading bed to seal a wrap about a sequenced group of product to form a package when the plate-like member is positioned over the loading bed and the hinged portion is positioned near an end of the loading bed, wherein the plate-like member moves the wrap over the product when the plate-like member moves to the second plate-like member position.

2. The apparatus of claim 1, wherein the loading position of the loading bed is a raised position descending to a lowered position as the product is placed on the loading bed.

3. The apparatus of claim 2, wherein the lowered position of the loading bed is a height which allows the plate-like member to laterally move over the product when the product is placed on the loading bed.

4. The apparatus of claim 1, wherein the loading position of the loading bed is a position aligned with a drop-off point of the product and the second position of the loading bed is a remote position for dropping the package therefrom.

5. The apparatus of claim 1, further comprising:

a clamping mechanism which holds a portion of the wrap during movement of the plate-like structure towards the loading bed;

a serrate mechanism to serrate the wrap when the sealing member seals the wrap to form the package; and a cutting mechanism to cut the wrap when the package drops from the loading bed.

6. The apparatus of claim 1, wherein the hinged portion is moveable between a first hinged position and a second hinged position, in the second hinged position, the hinged portion rests on an upper surface of the loading bed when the plate-like member is positioned over the loading bed.

7. The apparatus of claim 1, wherein the second plate-like member position is a raised position over product stacked on the loading bed.

8. The apparatus of claim 1, further comprising a clamping and serrate mechanism which clamps a portion of the wrap while the plate-like member moves other portions of the wrap over the product when moving toward the second plate-like member position, the clamping and serrate mechanism further serrates the wrap after the sealing member seals the wrap about the product.

9. The apparatus of claim 1, further comprising a wrap supply which supplies the wrap on the loading bed when in its loading position and over the product when the plate-like member is moved to its second position.

10. An apparatus, comprising:

a loading bed moveable between a loading position and a second position;

a plate-like member moveable with respect to the loading bed between a plate-like member loading position and a second plate-like member position, the plate-like member having a hinged portion;

a sealing member positioned at an end of the hinged portion, the sealing member cooperating with the loading bed to seal a wrap about a sequenced group of product to form a package when the plate-like member is positioned over the loading bed and the hinged portion is positioned near an end of the loading bed; and a wrap supply which supplies wrap when the plate-like member moves to the second plate-like member position.

11. An apparatus, comprising:

a loading bed moveable between a loading position and a second position;

a plate-like member moveable with respect to the loading bed between a plate-like member loading position and a second plate-like member position, the plate-like member having a hinged portion; and a sealing member positioned at an end of the hinged portion, the sealing member cooperating with the loading bed to seal a wrap about a sequenced group of product to form a package when the plate-like member is positioned over the loading bed and the hinged portion is positioned near an end of the loading bed, wherein the sequenced product is types of mail objects.

12. An apparatus for packaging product, comprising:

a loading bed moveable between a first position and a second position;

a bag former mechanism moveable with respect to the loading bed between a first bag former mechanism position and a second bag former mechanism position;

a hinged portion positioned at an end of the bag former mechanism;

a sealing member positioned at an end of the hinged portion, the sealing member cooperating with the loading bed to seal a wrap about product to form a package when the bag former mechanism is positioned over the loading bed and the hinged portion is positioned near an end of the loading bed; and a clamping and serrate mechanism positioned proximate to the sealing member, wherein the clamping and serrate mechanism clamps the wrap during the movement of the bag former mechanism toward the second bag former mechanism position, the clamping and serrate mechanism serrates the wrap after the sealing member seals the wrap to form the package, the bag former mechanism moves the wrap over the product on the loading bed when the bag former mechanism moves to the second bag former mechanism position.

13. The apparatus of claim 12, wherein the first position of the loading bed is a raised loading position descending to a lowered position during placement of the product on the loading bed, the lowered position being at a position which allows the bag former mechanism to move laterally into the second position over the product and the loading bed.

14. The apparatus of claim 12, wherein the hinged portion is moveable between a first hinged portion position and a second hinged portion position, in the second hinged portion position, the hinged portion rests on an upper surface of the loading bed when the bag former mechanism is positioned over the loading bed and the product.

15. The apparatus of claim 14, wherein the sealing member seals portions of the wrap when the hinged portion is in the second hinged portion position.

16. The apparatus of claim 12, wherein the bag former mechanism is moveable between a raised position and a lowered position, in the raised position, the bag former mechanism is movable over product stacked on the loading bed.

17. An apparatus, comprising:

a sequencing device sequencing mail objects, the sequencing device including an input and an output;

a packaging mechanism positioned proximate to the output of the sequencing device, the packaging mechanism packaging sequenced mail objects for delivery routes provided by the sequencing device, the packaging mechanism including:

a loading bed moveable between two positions;

a bag former mechanism moveable with respect to the loading bed between a first position substantially over the loading bed and a second position offset from the loading bed;

a hinged portion positioned at an end of the bag former mechanism; and a member positioned at a distal end of the hinged portion, the member cooperating with the loading bed to seal a wrap about a group of sequenced mail objects to form a package when the hinged portion is positioned near an end of the loading bed, wherein the positions of the loading bed and the bag former mechanism is a retractable position and a loading position with respect to one another.

18. The apparatus of claim 17, further including a clamping and serrate mechanism, the clamping and serrate mechanism clamps the wrap during the movement of the bag former mechanism toward a loading position of the two positions and serrates the wrap after the sealing member seals the wrap to form the package.

19. The apparatus of claim 17, wherein the hinged portion is moveable between a first position and a second position, in the second position, the hinged portion rests on an upper surface of the loading bed when the bag former mechanism is positioned over the loading bed.

20. An apparatus, comprising:

a loading bed moveable between a loading position of the loading bed and a second loading bed position;

a plate-like member moveable with respect to the loading bed between a loading position of the plate-like member and a second position of the plate-like member, the plate-like member having a hinged portion; and a sealing member positioned at an end of the hinged portion, the sealing member cooperating with the loading bed to seal a wrap about a sequenced group of product to form a package when the plate-like member is positioned over the loading bed and the hinged portion is positioned near an end of the loading bed, wherein the product is placed on a portion of the wrap when the loading bed is positioned in its loading position;

the wrap is positioned over the loading bed, initially without product, when the loading bed is in its loading position and the plate-like member is in its second position, and the plate-like member pulls a portion of the wrap over the product when moved to its second position.

* * * * *